US006176598B1

(12) United States Patent
Seligman et al.

(10) Patent No.: US 6,176,598 B1
(45) Date of Patent: Jan. 23, 2001

(54) LIGHT FIXTURE FLEXIBLE REFLECTOR

(75) Inventors: Marvin Seligman, Teaneck, NJ (US); Chi Yu, Brooklyn, NY (US)

(73) Assignee: Lowel-Light Manufacturing, Inc., Brooklyn, NY (US)

( * ) Notice: Under 35 U.S.C. 154(b), the term of this patent shall be extended for 0 days.

(21) Appl. No.: 09/293,412

(22) Filed: Apr. 16, 1999

(51) Int. Cl.[7] ..... F21V 1/06

(52) U.S. Cl. ..... 362/352; 362/355; 362/360; 362/278; 362/320; 362/450

(58) Field of Search ..... 362/352, 355, 362/360, 361, 278, 320, 450, 18

(56) References Cited

U.S. PATENT DOCUMENTS 2,205,860 * 6/1940 Olds ..... 362/278
3,294,962 * 12/1966 Hilzen ..... 362/352
4,834,126 * 5/1989 Sweet, Jr. ..... 135/25

* cited by examiner

*Primary Examiner*—Sandra O'Shea
*Assistant Examiner*—Ali Alavi
(74) *Attorney, Agent, or Firm*—Notaro & Michalos P.C.

(57) ABSTRACT

A light fixture for receiving commercially available reflectors or diffusers having flexible walls and a plurality of flexible struts, has a housing with a socket for receiving a lamp or lamps. A power connection is provided for supplying electrical power to the socket and a plurality of receivers are connected to the housing, each for receiving a free end of a strut. A mount is connected to the housing for mounting the housing to a stand or tripod or other appropriate support. Each of the receivers which are preferably in the form of tubes or blind bores, are positioned so that the free end of each strut must be bent into a braced position and inserted into a receiver. This deploys the flexible wall of the reflector or diffuser into its open reflecting position.

20 Claims, 7 Drawing Sheets

LIGHT FIXTURE FLEXIBLE REFLECTOR

FIELD AND BACKGROUND OF THE INVENTION

The present invention relates in general to photographic, videographic, digital imaging, cinemagraphic, theatrical, imaging of any type, or even environmental lighting, and in particular to a new and useful light fixture which is meant for use with umbrella-like reflectors having flexible struts and flexible sheet material walls.

In recent years it has become common for photographers and videographers to use softer, more distributed and diffuse light sources to illuminate their subjects, in preference to direct open faced or lensed lighting fixtures.

To achieve this effect it has become the norm to take a conventional lighting fixture and mount it at the rear of a large fabric reflector or lightbox approximating a parabola or any other curve in the manner of an umbrella without a stem or handle. Mounting is achieved by means of a ring assembly mounted to the lighting fixture in question and forms a secondary mount on to which umbrella-like struts of the reflector are mounted, with fabric stretched between them. Light diffusing fabric can then be stretched across the mouth of this reflector to break up the resulting light pattern, or is already attached across the mouth of the reflector.

This method requires the user to buy a special mounting ring for each of his or her conventional lighting fixtures in order to use them in the light box assembly. In addition to this, most conventional fixtures (by design) direct most of their output forward in a linear manner. A more efficient design would be to remove the lighting fixture and replace it with simply a lamp. In this way the entire fabric reflector surface is utilized by the rays of the lamp. Light would be emitted in a more efficient and diffuse manner. See U.S. Pat. Nos. 4,446,506; 4,633,374 and 4,807,089 for examples of umbrella reflectors.

SUMMARY OF THE INVENTION

An object of the present invention is to provide a simple lamp that can be used with umbrella-like reflectors and with the added benefit of removing the need for an additional mounting ring.

The lamp or lampholder assembly in a preferred version of the invention is mounted on the end of a piece of tube, the power connection being made by a portable cord at the base of this tube. Folding, hollow arms are mounted at the side of this tube and beneath the lamp assembly or to any light. The arms can be moved to the correct length and/or position to receive free ends of the struts of the reflector. Holes are provided at each of the free ends of arms to accept ends of the struts. Inserting the struts into the arms causes the whole assembly to brace into a rigid structure.

Accordingly, another object of the present invention is to provide a light fixture for a reflector having flexible walls and a plurality of flexible struts connected to the walls for creating a light-reflecting enclosure when the struts are extended into a braced position, each strut having a free inner end, the light fixture comprising a housing with a socket adapted to receive a lamp, power connection means connected to the socket for powering the lamp, a plurality of receivers connected to the housing, each positioned and oriented to receive a free end of a strut for holding the struts in the braced position, and mounting means connected to the housing for mounting the light fixture to a support.

A further object of the present invention is to provide a light fixture which can receive multiple flexible reflectors, and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
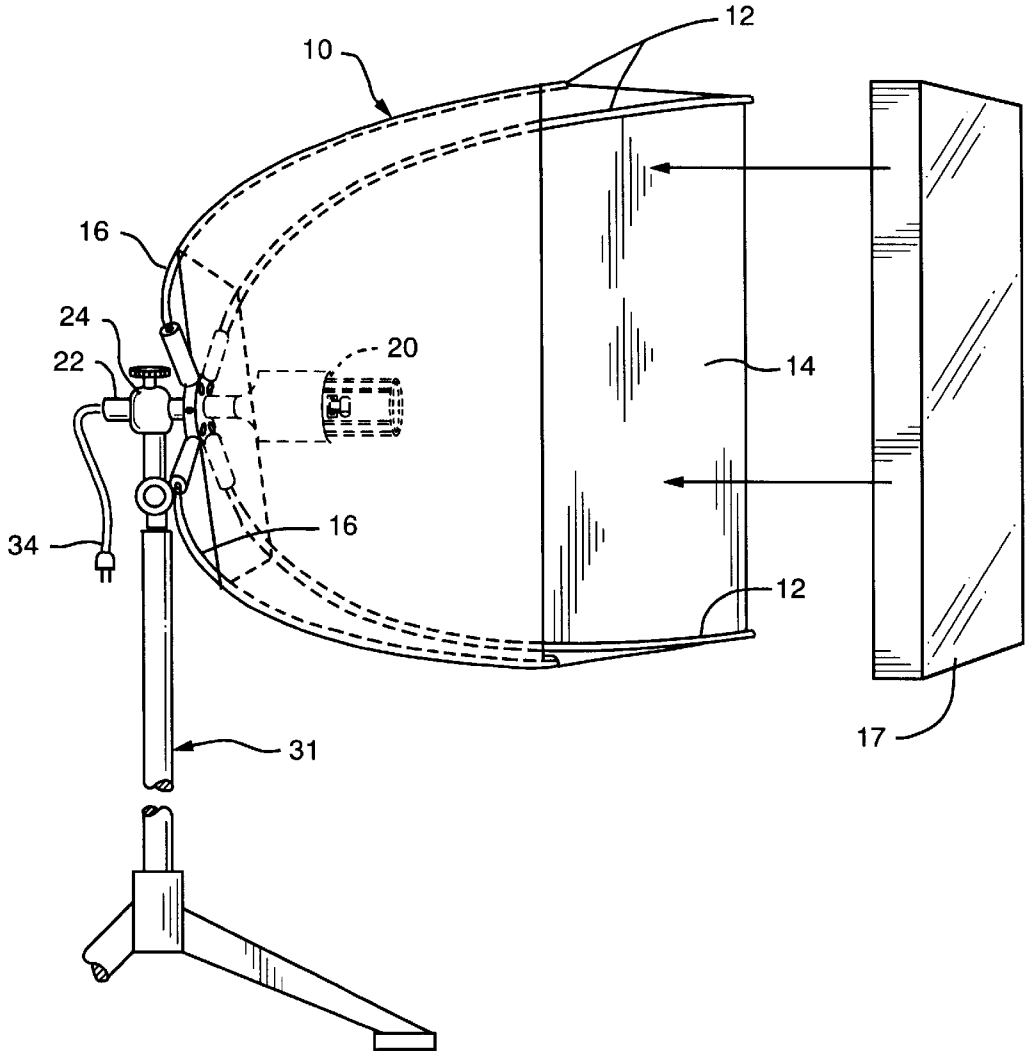
FIG. 1 is a perspective view of the light fixture with a flexible reflector in accordance with the present invention.

Referring to the drawings in particular, the invention embodied in FIG. 1 comprises a light fixture 20 shown in phantom line, inside a box-like reflexible reflector generally designated 10. The light fixture of the present invention includes a support tube or stem 22 with a mounting bracket 24, for supporting fixture 20 and the flexible reflector 10, on any appropriate support, such as a stand, tripod 30, or clamp.

Reflector 10 is known and is of the umbrella type and comprises a plurality of elongated flexible arms or struts 12 which, when held in a braced position as shown, stretch a flexible wall 14, engaged around the struts, into a reflecting enclosure. Flexible wall 14 has a light reflecting inner surface for reflecting light coming from light fixture 20, outwardly through the front opening of the enclosure. As is conventional, the front opening may be closed by a permanent or removable light dissipating, translucent cover 17 or may be provided with other ancillary parts for use in tailoring the light to the desires of a photographer, digital imager, videographer or the needs of architectural or theatrical lighting to be produced by fixture 20. Known diffusers that are closed but like reflector 10 have open ended struts and can also be used with the invention. These known diffusers have walls that are translucent rather than reflecting.

Each of the struts 12 has a free inner end 16 which, in the braced position of the reflector, is directed radially inwardly through a bending of the struts 12. This is what creates the reflective enclosure by virtue of stretching and opening of the flexible wall 14.

In accordance with the present invention, each of the free ends 16 of the struts 12 of the umbrella-like reflector 10, are held in the braced position by being "plugged" into an equal number of receivers provided on the stem part 22 of the housing of the light fixture 20.

Figure 2:
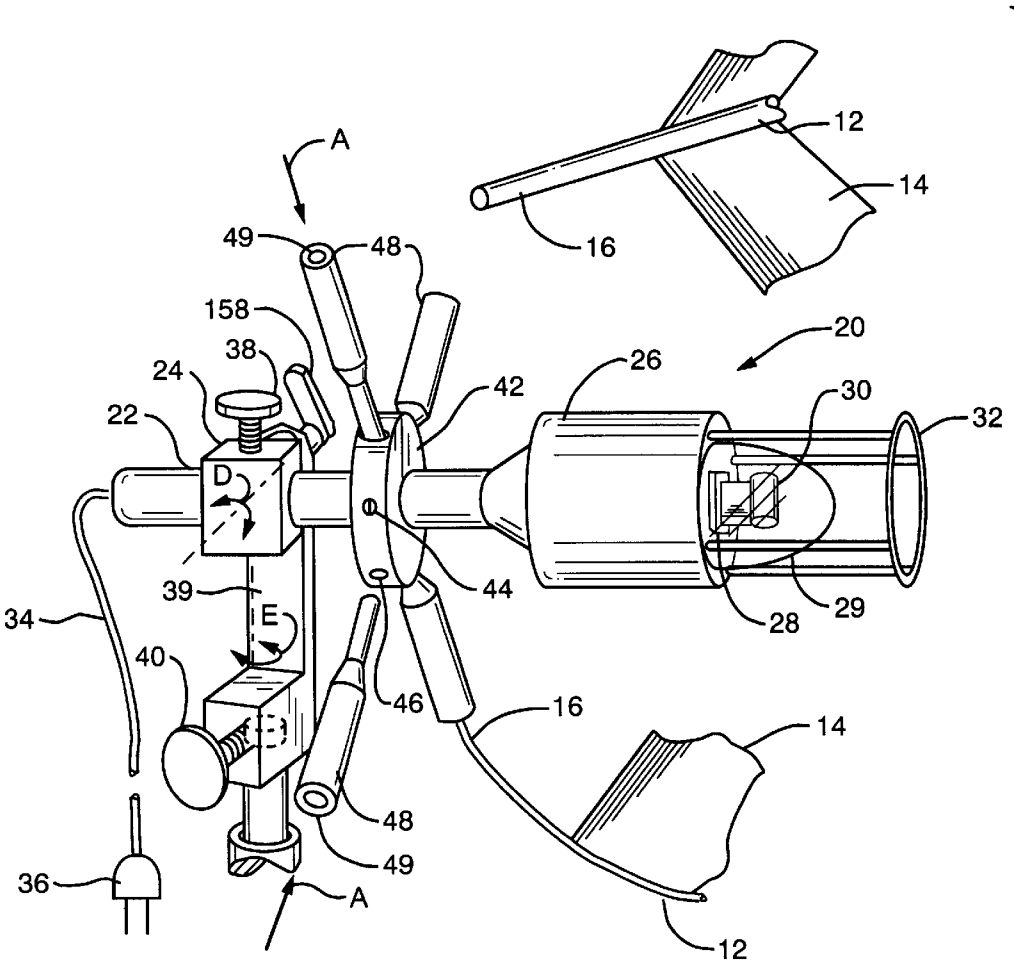
FIG. 2 is an enlarged perspective view of the light fixture of the present invention.

FIG. 2 is a perspective, exploded view of the present invention with part of the reflector illustrated to show the relationship between the light fixture 20 and the reflector in accordance with the present invention.

Light fixture 20 comprises a housing 26, which in the embodiment of FIG. 2, is a metal cylindrical enclosure containing a socket 28 for receiving an electric lamp 30, for example a quartz lamp for producing high intensity light when supplied with electricity through socket 28. For safety, a metal cage 32 is provided around the lamp 30 to maintain a safe spacing between the lamp and anything that may come in contact with the lamp since the lamp is extremely hot when in use. A glass dome or other cover 29 could also be used for safety, over lamp 30.

Figure 11:
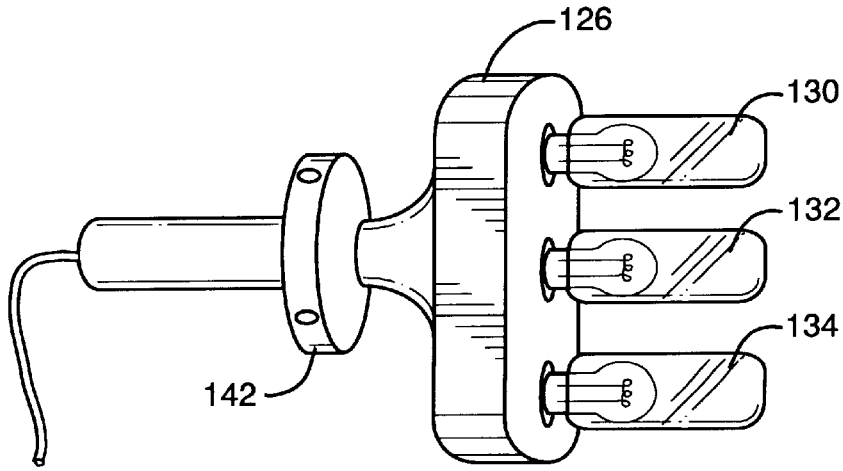
FIG. 11 is a schematic perspective view of a further embodiment of the invention.
Figure 12:
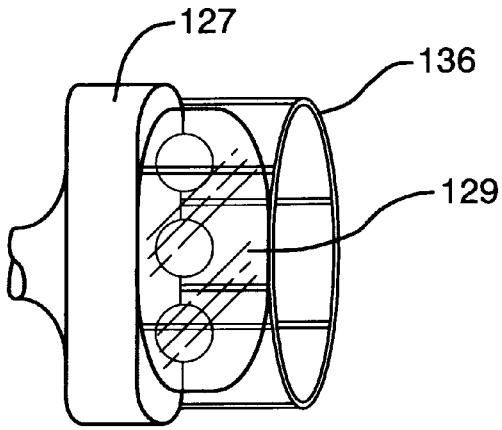
FIG. 12 is a partial schematic perspective view of a still further embodiment of the invention.

In the embodiment of FIGS. 11 and 12, multiple light sources or lamps 130, 132 and 134 are screwed into respective sockets in a single fixture housing 126. A disk 142 or any of the other structures for engaging the inner ends of umbrella struts are provided at the rear of housing 126. In the embodiment of FIG. 11, lamps 130, 132 and 134 are of the type with outer glass shells containing a glass covered filament or electrode set. In the embodiment of FIG. 12, three quartz lamps of the high temperature type are mounted in respective sockets in a common housing 127. They can be covered with an outer glass dome 129, and for further safety against mechanical damage (i.e. for bumping against a hard object), are further encased by a cage 136.

Returning to FIG. 2, cylindrical stem 22 is connected to and extends rearwardly of cylinder 26 and completes the fixture housing. A power cord or cable 34 extends into or is plugged into the rear of stem 22 and is electrically connected to socket 28 so that, when a plug 36 of cord 34 is plugged into an electrical outlet, lamp 30 can be lit. The mounting mechanism 24 includes a casing which is made of metal or plastic with a hole for axially receiving stem 22 and a tightening knob 38 which can be rotated to fix the relative position between the mount 24 and the stem 22. Additional hardware in the form of a bracket 39 extends downwardly of the casing and carries another knob 40 which can be tightened to hold onto the conventional stud or any other appropriate hardware for attaching the mount 24 to an appropriate support, such as tripod 31 shown in FIG. 1. FIG. 2 also illustrates how an additional handle or knob 158 can be used to allow rotation between mounting mechanism 24 and bracket 39. By loosening handle 158, mechanism 24 can tilted around an axis in the direction of curved arrow D. The back end of stem 22 can be held by the hand and used as a handle to control this tilting. When tilted into the right position, knob 158 can be tightened to fix this position. In likewise fashion, knob 40 can be loosened to allow rotation of the entire fixture around a vertical axis and in the direction of curved arrow E, on the stand or support for the fixture. Here again, the rear end of stem 22 can be used as a handle to control this tilting movement.

Friction connections, instead of threaded knobs, can also be used which allow tilting, but then holds the position once the fixture is tilted into a desired position.

Also mounted on stem 22 is a tube support 42 which, in the embodiment of FIG. 2, is a cylindrical disk having a hole through the axial center thereof for receiving stem 22. Support 42 is moveable along stem 22 but can be fixed in position on stem 22 by set screws 44, and includes four circumferentially and equally spaced radial bores 46 which extend from the outer perimeter of support 42 inwardly toward the stem 22. Set screw 44 can be replaced with a screw knob so that axial adjustment of lamp 30 on stem 22 is possible to change the focal position of the lamp in the reflector and also to rotate the reflector.

Figure 10:
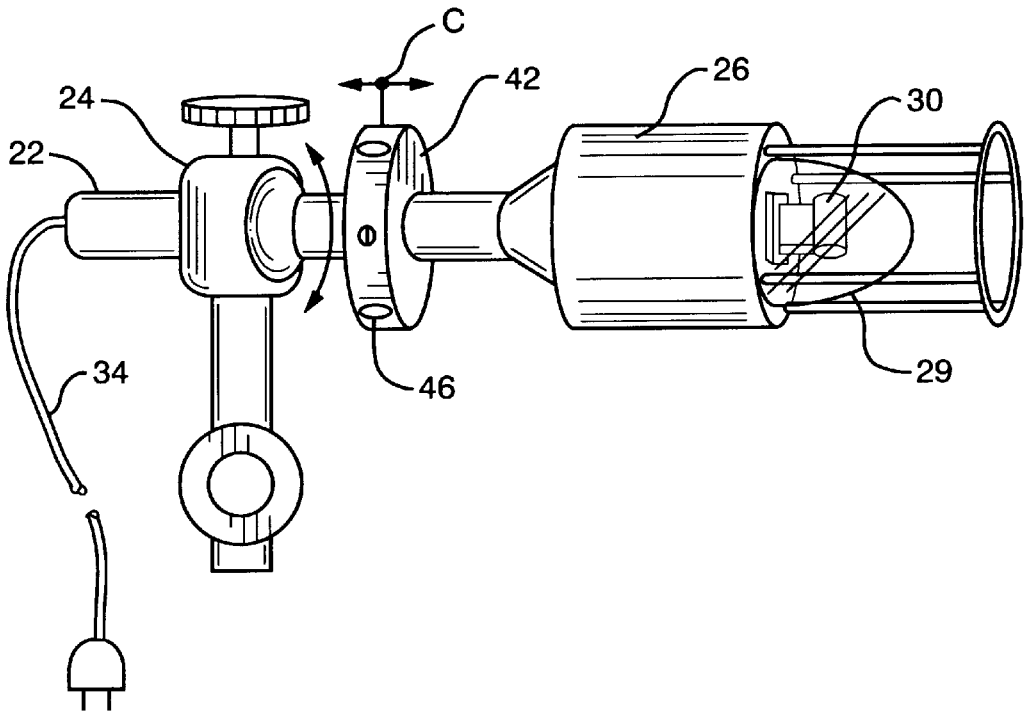
FIG. 10 is a perspective view of a still further embodiment of the light fixture according to the present invention.

Each bore 46 receives an inner end of a strut holder tube 48. Each of the strut holder tubes 48 is moved in the direction of arrow A into its respective bore 46 to produce a cross or star configuration with each of the four strut holder tubes extending outwardly from the stem 22, around the light fixture 20. As shown in FIG. 10, block 24 may be a ball and socket structure with stem 22 slidable in the ball. This allows stem 22 to tilt and pan on a stand, and to axially move 22 in block 24.

In order to position a flexible reflector 10 onto fixture 20, each of the free ends 16 of the struts 12 as shown at the top of FIG. 2, is brought to the vicinity of the end of each of the strut holder tubes 48. Each strut holder tube 48 has a blind bore 49 which also extends radially and is adapted with regard to depth and diameter to receive one of the free ends 16 of one of the struts 12. By virtue of the radial extension and rigid mounting of the holder tubes 48 and the central support 42, when the struts 12 are bent so that each of their free ends is engaged into a corresponding one of the blind bores 49, the struts are automatically placed in their braced position for expanding the reflector into the operational position shown in FIG. 1.

In accordance with the present invention, a functional light fixture 20 is thus provided with simple and effective means for engaging the free ends of any number of types of flexible reflectors 10 which are currently on the market and which currently require special rings which are manufactured for each of the various commercial lights available.

Figure 3:
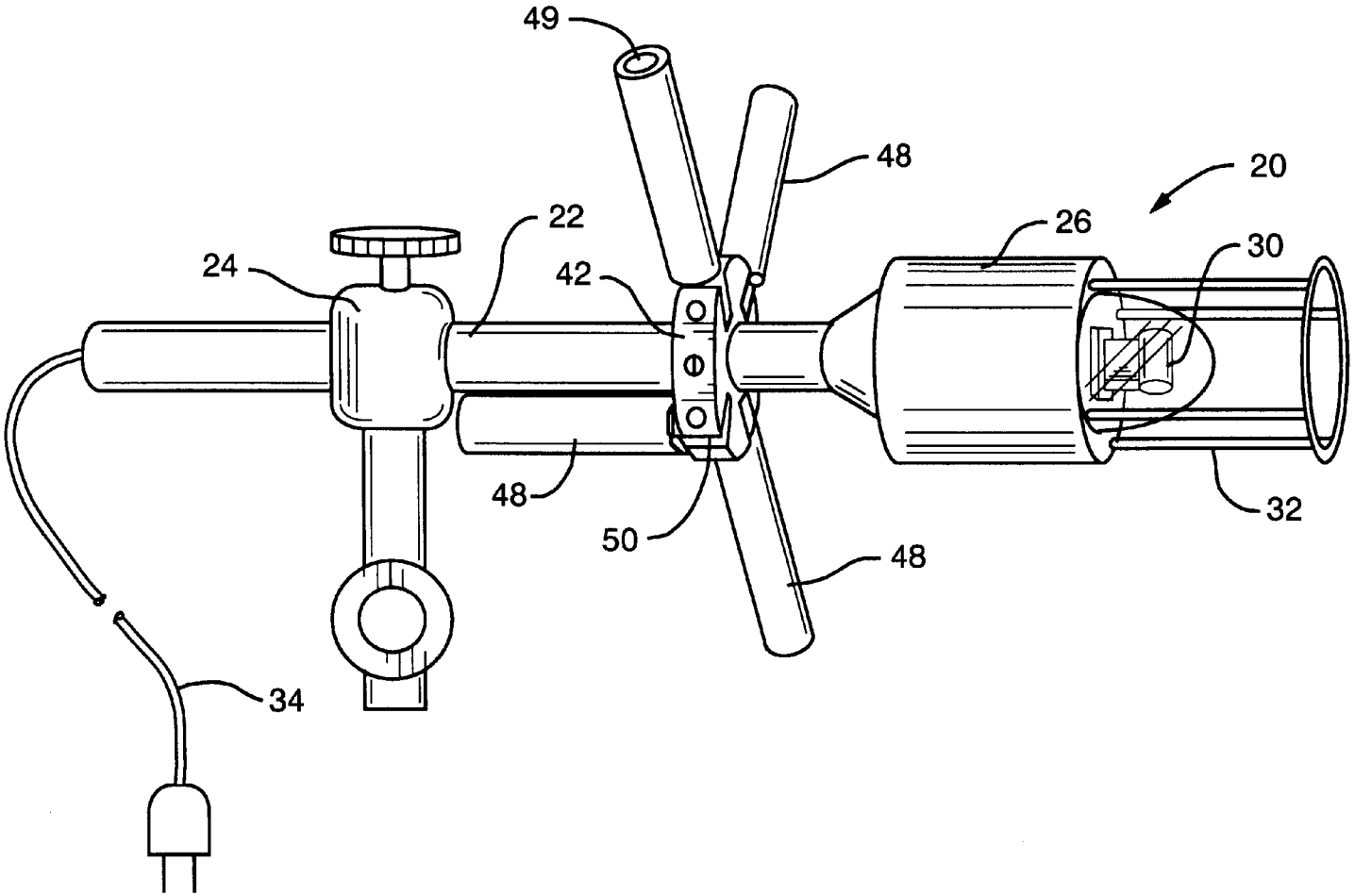
FIG. 3 is a view similar to FIG. 2 of another embodiment of the invention.

FIG. 3 shows another embodiment of the invention where the same reference numerals are utilized to designate the same or functionally similar parts. In FIG. 3 each of the strut holder tubes 48, rather than being plugged into openings in the central support 42, are pivotally mounted in slots 50 which are circumferentially and equally spaced around the perimeter of disk-shaped support 42. Stem 22 may have a length to permit the rearward folding of each of the tubes 48, so that the tubes may lie flat against and parallel to the stem 22. One of the tubes 48 is shown in this folded position while the remaining three tubes are shown in their extended position.

Figure 4:
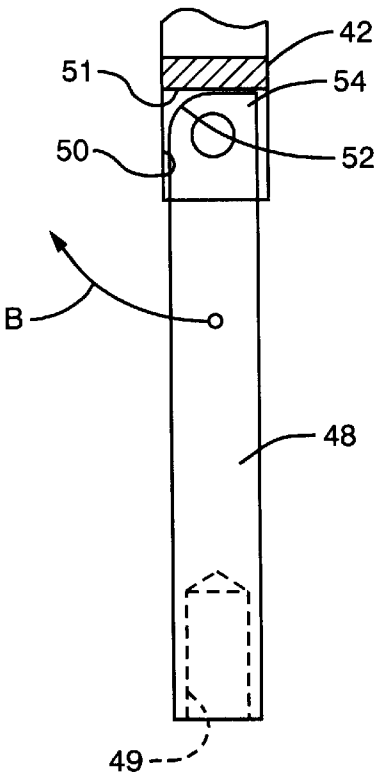
FIG. 4 is a side elevational view of a strut holder tube in accordance with the present invention.

As shown in FIG. 4, the inward flat and axially extending wall 51 of each of the slots 50 closely receives the inner end of a respective tube 48. In order to permit pivoting of each tube 48 in the direction of an arrow B, into the folded position shown for one of the tubes in FIG. 3, the inner end of each of the tubes 48 has a curved rear corner portion 52 and an angular front corner portion 54. Corner portion 54 will brace up against the inner wall 51 of slot 50 if tube 48 is pivoted in a direction opposite to arrow B. This prevents pivoting of tube 48 in this direction and establishes the bent and braced position of each of the struts 12. If tube 48 were permitted to pivot freely in the direction opposite to arrow B, the braced position for the struts of the umbrella-like reflector would not be established.

Figure 5:
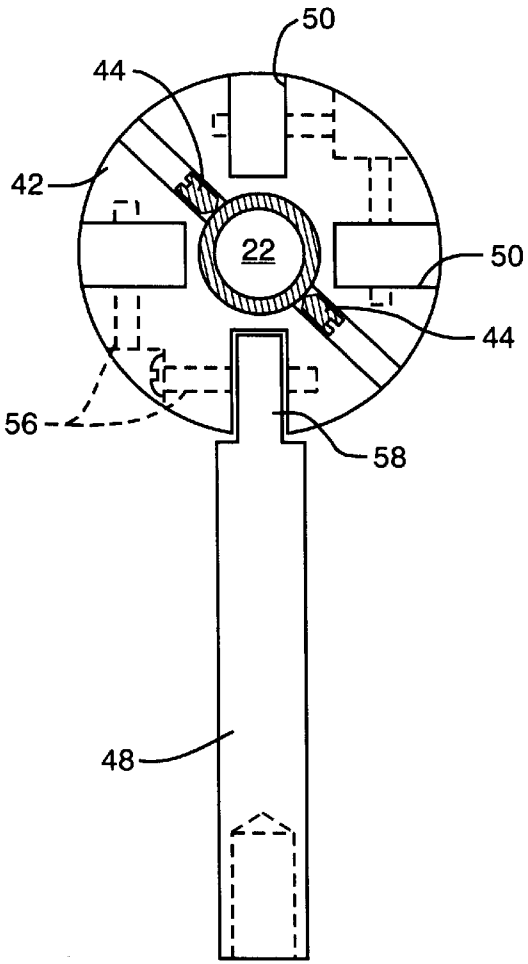
FIG. 5 is a front view of the tube of FIG. 4.

Bores 56 in support 42 shown in FIG. 5, extend in the direction of a cord in the disk shaped support 42, for receiving a screw to pivotally hold each of the tubes 48. FIG. 5 also illustrates the positions of set screws or other fasteners 44. To more positively brace the support 42 on the stem 22, two oppositely effective set screws 44 are preferably used. In the embodiment of FIGS. 4 and 5, tube 48 is a solid cylindrical tube of appropriate metal such as aluminum with blind bore 49 drilled into the outer end of the tube. The inner end of each tube 48 is provided with a flat tab 58 which can be machined from the cylindrical tube 48 to extend into its receiving slot 50 in support 42 and to have round and square corners 52, 54.

Figure 7:
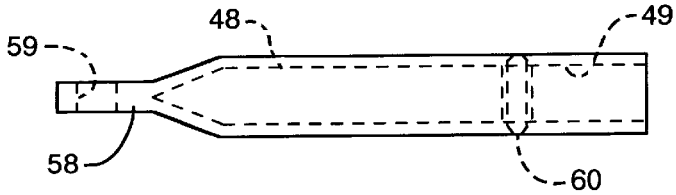
FIG. 7 is a front elevational view of another embodiment of a strut holder tube in accordance with the present invention.
Figure 8:
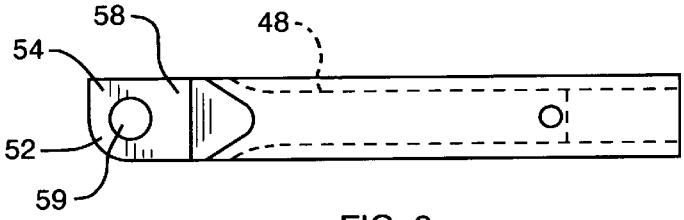
FIG. 8 is a side elevational view of the embodiment of FIG. 7.

A more economical tube 48 is illustrated in FIGS. 7 and 8. In this embodiment each of the tubes is formed by a hollow tubular metal member with the tab 58 being formed by squeezing the inner end of the tube and drilling the inner end, for example to form a hole 59, for receiving the pivot screw for holding the tube to the support (not shown in FIGS. 7 and 8).

The hollow interior of tube 48 is formed into a blind bore 49 at the outer end of the tube by a transverse screw or other member or stop 60 which extends in a transverse hole that is spaced inwardly from the outer end of the tube 48 in the embodiments of FIGS. 7 and 8.

Figure 9:
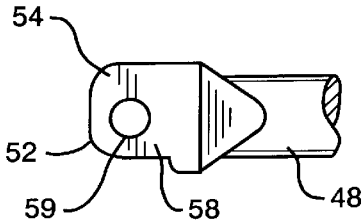
FIG. 9 is a side view of the end of another embodiment of a strut holder tube according to the present invention.

FIG. 9 shows a still further embodiment of the invention where the pivot tab 58 is a separate piece of metal which is connected to a smaller diameter tube 48.

Figure 6:
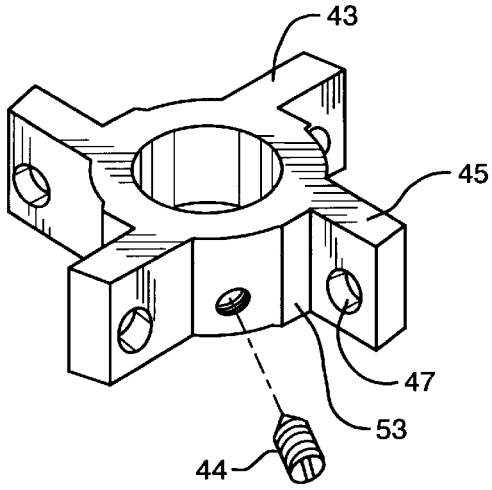
FIG. 6 is a perspective view of a tube support for holding a plurality of strut holder tubes in accordance with another embodiment of the invention.

FIG. 6 illustrates another embodiment for the support, this time in the form of a cross member 43 having a plurality of radially outwardly extending tabs 45 each with a hole 47 for receiving a pivot pin for connecting one of the tubes 48 to the support 43. Each of the tabs 45 is adjacent a space having an inner wall 53 against which the corner portion 54 of the tube can rest to permit the tube to pivot in one direction with respect to the support 43 but not in the opposite direction.

FIG. 10 shows a still further embodiment of the invention which is similar to the embodiment of FIG. 2 except that the support 42 is provided with bores 46 which are deep enough to themselves receive the free ends 16 of the struts 12. The embodiment of FIG. 10 is equally capable of receiving any appropriately constructed reflexible reflector 10.

Although four reflecting walls are shown in the reflector 10 of FIG. 1, it is understood that the present invention can be utilized with any number of struts from two and up, to provide a reflector of any polygonal or circular shape. The invention can also accommodate a diffuser structure for diffusing the light. It is important, however, that a sufficient number of strut and receiving openings be provided, however, either in the form of fixed or pivotal tubes 48 or in the form of the blind bores 46 alone. Preferably, an equal number of strut end receiving openings to the number of struts is provided according to the present invention.

Figure 13:
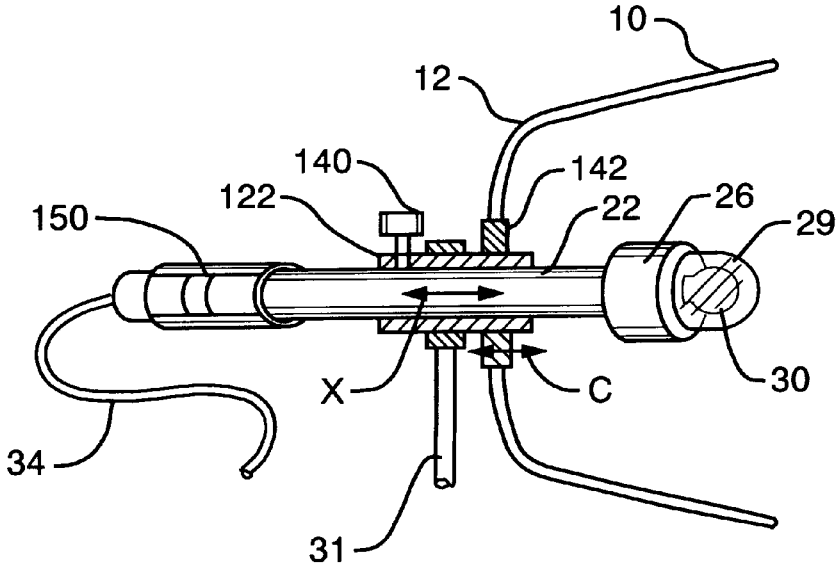
FIG. 13 is a sectional view, partly in elevation, of a still further embodiment of the invention.

FIG. 13 shows a further embodiment of the invention where mounting tube 22 carries, at one end, the housing 26 for at least one lamp 30 with a protective dome cover 29, and has an outer end for power cord 34. In the embodiment of FIG. 13, stem 22 is held within an outer tube 122 and the relative position between stem 22 and tube 122 can be adjusted in the direction of double arrow X, and fixed by a screw 140. This, in effect, can change the efficiency of the lamp or light source 30 within the umbrella reflector or diffuser 10 to change, for example, the intensity of the light and/or the quality of the shadows cast from the subject. This also allows the lamp to be pulled back from the diffuser or pushed closer to it to accommodate different sized reflectors and diffusers. This is done because means 142 for engaging the inner ends of the umbrella struts 12, are fixed with respect to the stand 31 since outer tube 122 is fixed to the stand rather than to the stem 22. Alternatively means 142 may be moved in the direction of double arrow C to achieve this adjustment or may be rotated around 122. FIG. 13 also shows the use of a rubber or other flexible handle cover 150 over a length of stem 22 to be used to help tilt the fixture on its stand. These tilt features, handle features and adjustability features, can apply to all embodiments of the invention.

While specific embodiments of the invention have been shown and described in detail to illustrate the application of the principles of the invention, it will be understood that the invention may be embodied otherwise without departing from such principles.

What is claimed is:

1. A light fixture for a reflector or diffuser having flexible walls and a plurality of flexible struts connected to the walls for creating a light reflecting or diffusing enclosure when the struts are extended into a bent braced position, each strut having a free inner end, the light fixture comprising:

a housing with a socket adapted to receive a lamp;

power connection means connected to the socket for powering the lamp;

a plurality of movable receivers connected to the housing, each receiver being positioned and oriented to receive an end of a strut of the reflector or diffuser, for holding the strut in the braced position; and mounting means connected to the housing, for mounting the light fixture to a support;

said plurality of receivers comprising a star shaped support connected to said housing and a plurality of tubes pivotally connected to said star shaped support, each tube carrying a blind bore at an outer end thereof for receiving an end of a strut.

2. A light fixture according to claim 1 wherein said plurality of movable receivers comprise a support connected to said housing and a plurality of circumferentially spaced blind bores extending radially in said support and around said housing and a plurality of tubes connected to said support and extending radially outwardly of said support, each tube carrying one of said blind bores.

3. A light fixture according to claim 2 wherein said tubes each have inner ends which extend into an opening in said support.

4. A light fixture according to claim 2 wherein said tubes are pivotally connected to said support.

5. A light fixture according to claim 3 wherein each tube is solid.

6. A light fixture according to claim 3 wherein each tube is hollow.

7. A light fixture for a reflector or diffuser having flexible walls and a plurality of flexible struts connected to the walls for creating a light reflecting or diffusing enclosure when the struts are extended into a bent braced position, each strut having a free inner end, the light fixture comprising:

a housing with a socket adapted to receive a lamp and oriented to face away from each free inner end of the struts;

power connection means connected to the socket for powering the lamp;

a plurality of movable receivers connected to the housing, each receiver being positioned and oriented to removable receive an end of a strut of the reflector or diffuser, for holding the strut in the braced position and for releasing the strut so that different reflectors and diffusers can be used with said light fixture; and mounting means connected to the housing, for mounting the light fixture to a support.

8. A light fixture according to claim 7 wherein said housing includes safety means for the lamp.

9. A light fixture according to claim 7 wherein said housing includes a stem, said plurality of receivers comprising a support fixed to said stem at an axially adjustable location, and a plurality of bores circumferentially spaced around said support for receiving the free ends of said struts.

10. A light fixture according to claim 9 wherein said stem includes a portion extending beyond said housing to form a handle for tilting the light fixture.

11. A light fixture according to claim 9 wherein said plurality of receivers comprise a support connected to said housing and a plurality of circumferentially spaced blind bores extending radially in said support and around said housing.

12. A light fixture according to claim 11 including a plurality of tubes connected to said support and extending radially outwardly of said support, each tube carrying one of said blind bores.

13. A light fixture according to claim 12 wherein said blind bores each have inner ends which extend into an opening inset support.

14. A light fixture according to claim 12 wherein said tubes are pivotally connected to said support.

15. A light fixture according to claim 14 wherein each tube has an inner end with a rear curved corner and a forward angled corner, said support having an axially extending wall adjacent the inner end of each tube for permitting pivoting of each tube in one direction and for precluding pivoting of said tube in an opposite direction.

16. A light fixture according to claim 7 wherein said mounting means includes means for at least one of tilting and panning the light fixture on a stand.

17. A light fixture according to claim 7 including cage means around said light fixture and connected to said housing.

18. A light fixture according to claim 17 including a glass cover connected to the housing, over the lamp.

19. A light fixture according to claim 7 wherein said housing comprises a stem and said receivers are on a support that is at least one of axially and rotatably moveable on said stem.

20. A light fixture for a reflector or diffuser having flexible walls and a plurality of flexible struts connected to the walls for creating a light reflecting or diffusing enclosure when the struts are extended into a bent braced position, each strut having a free inner end, the light fixture comprising:

a housing with a socket adapted to receive a lamp;

power connection means connected to the socket for powering the lamp;

a plurality of movable receivers connected to the housing, each receiver being positioned and oriented to receive an end of a strut of the reflector or diffuser, for holding the strut in the braced position;

mounting means connected to the housing, for mounting the light fixture to a support; and a support connected to said housing;

said receivers comprising a plurality of tubes circumferentially space around, pivotally connected to, and extending radially outwardly of said support, each tube having an outer end with a blind bore for receiving an strut end, each tube having an inner end with a rear curved corner and a forward angled corner, said support having an axially extending wall adjacent the inner end of each tube for permitting pivoting of each tube in one direction and for precluding pivoting of said tube in an opposite direction.

* * * * *